US010435973B2

(12) United States Patent
Viassolo et al.

(10) Patent No.: US 10,435,973 B2
(45) Date of Patent: Oct. 8, 2019

(54) ASSESSMENT OF PUMPOFF RISK

(71) Applicant: Halliburton Energy Services, Inc., Houston, TX (US)

(72) Inventors: Daniel E. Viassolo, Katy, TX (US); Randy Coles, Spring, TX (US); Muralidhar Seshadri, Sugar Land, TX (US); Daniel M. Saban, Spring, TX (US); Wesley Neil Ludwig, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 262 days.

(21) Appl. No.: 15/520,015

(22) PCT Filed: Nov. 19, 2014

(86) PCT No.: PCT/US2014/066393
§ 371 (c)(1),
(2) Date: Apr. 18, 2017

(87) PCT Pub. No.: WO2016/080982
PCT Pub. Date: May 26, 2016

(65) Prior Publication Data
US 2017/0314353 A1 Nov. 2, 2017

(51) Int. Cl.
*E21B 23/14* (2006.01)
*E21B 23/08* (2006.01)
(Continued)

(52) U.S. Cl.
CPC ..... *E21B 23/08* (2013.01); *E21B 23/14* (2013.01); *E21B 41/0092* (2013.01); *E21B 47/00* (2013.01)

(58) Field of Classification Search
CPC ..... E21B 41/0092; E21B 23/14; E21B 23/08
See application file for complete search history.

(56) References Cited

U.S. PATENT DOCUMENTS 5,823,262 A 10/1998 Dutton
6,138,764 A 10/2000 Scarsdale et al.
(Continued)

FOREIGN PATENT DOCUMENTS

WO 2011017626 2/2011
WO 2013039480 3/2013
WO 2014099723 6/2014

OTHER PUBLICATIONS

Godhavn et al., "Drilling Seeking Automatic Control Solutions", Aug. 28, 2011, 9 pages.
(Continued)

*Primary Examiner* — Catherine Loikith
(74) *Attorney, Agent, or Firm* — Kilpatrick Townsend & Stockton LLP

(57) ABSTRACT

An automated system for assessing pumpoff risk can be used to warn operators and/or control machinery in order to avoid pumpoff. Pumpoff risk is assessed through the use and/or comparison of one or more models of pumpoff risk. These models can include a sand build up model (e.g., to determine the threshold buildup size where pumpoff risk is too great), a line speed increase model (e.g., to determine the maximum flow rate allowable given a maximum support line feed rate), a residual error comparison model (e.g., to compare the deviation of predicted tension from actual tension), and a statistical analysis model (e.g., to determine likelihood of pumpoff given statistical probability of each of a multitude of possible scenarios).

20 Claims, 10 Drawing Sheets

(51) Int. Cl.
*E21B 41/00* (2006.01)
*E21B 47/00* (2012.01)

(56) References Cited

U.S. PATENT DOCUMENTS

| | | | | |
|---|---|---|---|---|
| 6,220,087 | B1 | 4/2001 | Hache et al. | |
| 6,453,239 | B1 | 9/2002 | Shirasaka et al. | |
| 6,497,281 | B2 | 12/2002 | Vann | |
| 6,622,791 | B2 | 9/2003 | Kelley et al. | |
| 6,868,906 | B1 | 3/2005 | Vail, III et al. | |
| 7,108,084 | B2 | 9/2006 | Vail, III | |
| 8,136,395 | B2 | 3/2012 | Pop et al. | |
| 8,589,136 | B2 | 11/2013 | Ertas et al. | |
| 2011/0174541 | A1 | 7/2011 | Strachan et al. | |
| 2012/0123757 | A1 | 5/2012 | Ertas et al. | |
| 2013/0138254 | A1 | 5/2013 | Seals et al. | |
| 2015/0330172 | A1* | 11/2015 | Allmaras | E21B 23/08 166/250.01 |
| 2017/0241221 | A1* | 8/2017 | Seshadri | E21B 23/08 |

OTHER PUBLICATIONS

Mirhaj et al., "Improvement of Torque-and-Drag Modeling in Long-Reach Wells", Modern Applied Science, vol. 5, No. 5, Oct. 2011, pp. 10-28.
Mitchell, "Drillstring Solutions Improve the Torque-Drag Model", 2008, 2 pages.
International Patent Application No. PCT/US2014/066393, "International Search Report and Written Opinion", dated Aug. 17, 2015, 16 pages.

* cited by examiner

ASSESSMENT OF PUMPOFF RISK

CROSS-REFERENCE TO RELATED APPLICATIONS

This is a U.S. national phase under 35 U.S.C. 371 of International Patent Application No. PCT/US2014/066393 titled "Assessment Of Pumpoff Risk" and filed Nov. 19, 2014, the entirety of which is incorporated herein by reference.

TECHNICAL FIELD

The present disclosure relates to oilfield operations generally and more specifically to conveying a tool in a wellbore.

BACKGROUND

In certain oilfield operations tools must be placed at a certain depth in a wellbore. In order to reach that depth, often tools must be conveyed downwell with the help of a pressurized medium, such as a pressurized fluid pumped from the surface, pumped behind the tool to help push the tool downwell. Such an operation can be known as a pumpdown operation. Tools can be supported from the surface by a line, such as a wireline, having a finite tensile strength.

During a pumpdown operation, there is a risk that tension may increase in the support line to an extent that the support line is damaged or completely severed (e.g., at a weakpoint where the support line attaches to the tool), known as pumpoff, which requires expensive and time-consuming remediation. Pumpoff can be avoided by regulation of pump pressure and support line feeding speed, each of which is managed by a human operator in a separate location. Each operator can be in vocal communication, such as through a telephone or radio. Due to the nature of wellbore interiors, operators may be required to react in a very short time frame (e.g., one to a few seconds), without much warning, in order to avoid pumpoff. Operators must react based only on the variables available to them, including pump pressure, surface tension, and support line feeding speed. Operators rely largely on experience to avoid pumpoff. With manual operator control, pumpoff risk remains substantial due at least in part to the restraints from human reaction times, human error, and the imprecision of manual control.

BRIEF DESCRIPTION OF THE DRAWINGS

The specification makes reference to the following appended figures, in which use of like reference numerals in different figures is intended to illustrate like or analogous components

DETAILED DESCRIPTION

Figure 1:
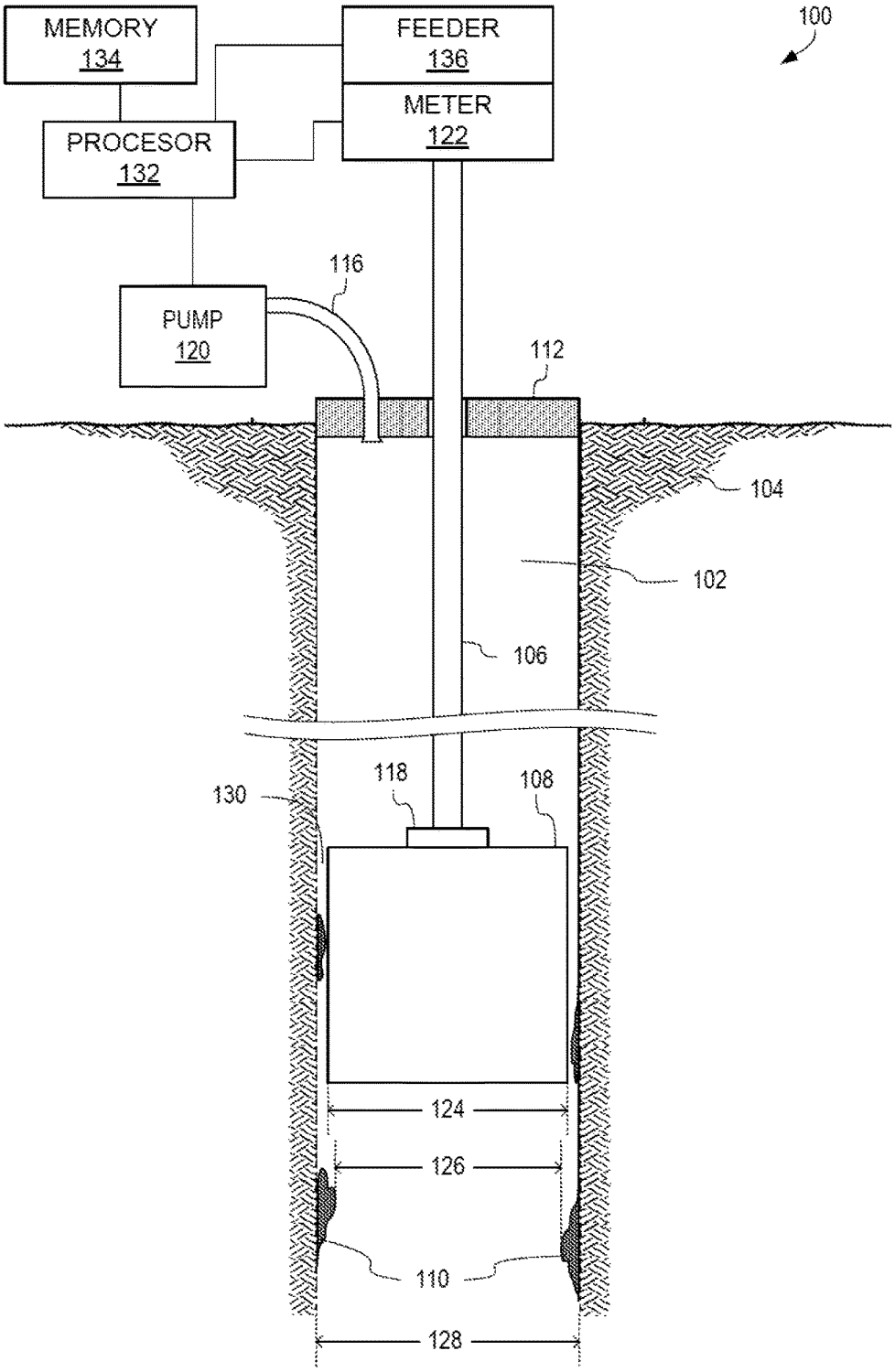
FIG. 1 is a schematic diagram of a wellbore servicing system that includes a tool positioned by a pumpdown operation, according to one embodiment.

Certain aspects and features of the present disclosure relate to an automated system for assessing pumpoff risk, which can be used to warn operators and/or control machinery in order to avoid pumpoff. Pumpoff risk is assessed through the use and/or comparison of one or more models of pumpoff risk. These models can include a sand build up model (e.g., to determine the threshold buildup size where pumpoff risk is too high), a line speed increase model (e.g., to determine the maximum pump flow rate allowable given a maximum support line feed rate), a residual error comparison model (e.g., to compare the deviation of predicted tension from actual tension), and a statistical analysis model (e.g., to determine likelihood of pumpoff given statistical probability of each of a multitude of possible scenarios).

In some embodiments, a tool is being run downwell to a desired location. In an embodiment, the tool can be a perforation tool that is being run to a desired location based on the need for perforations at a certain location in the wellbore. To run a tool downwell, a pressurized medium, such as a pressurized fluid, can be pumped into the wellbore behind the tool to provide pressure behind the tool to overcome friction and obstacles that would otherwise slow or stop forward travel (e.g., towards the toe of the wellbore) of the tool in the wellbore. While the tool is described herein as running within a wellbore, the tool can be run within a bare wellbore, a casing, or any tubular using the same pumpoff risk assessment methods described herein.

The tool can be supported by a support line. The support line can provide a physical connection to retrieve the tool (e.g., pull the tool back up to the surface), as well as any electrical, fluid, or other connections necessary for the operation for the tool. The support line can have a finite tensile strength. If too much tension is applied to the support line, the support line can be damaged and/or severed, which can be known as "pumpoff."

To avoid pumpoff, modeling can be used to determine a risk of pumpoff given certain conditions. Models can be physics-based (e.g., calculated outcomes based on known well measurements), empirical or statistical (e.g., estimated based on known outcomes from similar circumstances), or a combination thereof. Models can assume a closed-loop controller used to keep the pumpoff procedure near a desired tension or under a maximum allowed tension. In an embodiment, a closed-loop controller takes a target tension (e.g., desired tension) and a measured tension (e.g., actual tension of the support line in use) and then controls the support line feed rate and pump flow rate in order to drive the measured tension towards the target tension.

The concepts described herein outline several methods of modeling pumpdown procedures and using the models to assess pumpoff risk. In addition to the methods described below, one can use a combination of one or more of the below-mentioned methods to determine an aggregate pumpoff risk, such as by taking an average or a weighted average of the various pumpoff risk assessments described below. Additionally, the risk assessment from one or more of the below-mentioned methods can be used to dynamically adjust the tolerances of the other methods (e.g., to make the other methods more or less sensitive). In some embodiments, a high risk assessed by one method may make the risk assessment more sensitive in another method, whereas a low risk assessed by the one method may make the risk assessment less sensitive in the other method.

In a first embodiment, pumpoff risk can be estimated based on a model of clearing blockages. In a pumpdown procedure, the outer diameter of the tool can be slightly smaller than the inner diameter of the wellbore, resulting in an annulus between the outer diameter of the tool and the inner diameter of the wellbore. As the tool is pumped down into the wellbore, the tool can encounter blockages on the wall of the wellbore. Examples of blockages can include buildups (e.g., sand, paraffin, and other debris) that build up on the walls of the wellbore, as well as other blockages that reduce the cross-sectional area of the wellbore (e.g., corrosion of the walls or a partially collapsed wall). Other blockages may be present. Blockages can unpredictably decrease the inner diameter of the wellbore and block passage of the tool.

In order to push the tool past a blockage, an operator can supply additional pressure through the pump until the pressure applied is sufficient to overcome the blockage. In such situations, the tool will accelerate dramatically once the blockage is cleared, due to the pressure added to clear the blockage in the first place. Rapid acceleration of the tool can lead to increased tension on the support line, especially if the support line feed rate is slower than the accelerated speed of the tool after the blockage is cleared. Larger blockages can require larger pressure buildups, which result in larger tool accelerations once the blockage is cleared. Therefore, the risk of pumpoff increases when the size of the blockage increases.

A model can be used to estimate the size of the largest blockage that can be cleared by the closed-loop control under the current operating regime. The current operating regime can take into account one or both of the present support line feed rate and the present pumpdown fluid flow rate. If the output of the model indicates that, in current operating regime, only a very small blockage can be cleared, than the system can provide an indication that the pumpoff risk is high. Such indication can encourage an operator to either lower the pumpdown fluid flow rate or increase the support line feed rate as soon as possible to move into an operating regime with lower risk.

In some embodiments, the pumpoff risk can be based on the present support line feed rate and pumpdown fluid flow rate. The model can determine the maximum size blockage that can be cleared at the current support line feed rate before a pumpoff is likely to occur. The maximum size blockage determined from the model can be compared to a threshold size. The maximum size blockage as compared with the threshold size can be used to determine the risk of pumpoff. As the maximum size blockage approaches the threshold size, the pumpoff risk can increase. For example, a maximum size blockage that is above 90% of the threshold risk can indicate a high risk of pumpoff and a maximum size blockage that is between 80% and 90% of the threshold risk can indicate a medium risk of pumpoff. The threshold risk, as well as the acceptable percentage ranges can be predetermined based on an acceptable level of risk. The tolerance of this method of assessing pumpoff risk is based on the threshold size and the acceptable percentage ranges. Changes to the tolerance of this method, such as to make this method more or less sensitive, can be made by adjusting one or both of the threshold size and acceptable percentage ranges.

In some embodiments, the maximum size blockage can be determined as follows. Parameters of the closed loop controller can be fixed and a blockage can be simulated. The blockage can be set to have a predetermined shape (e.g., a triangle). Simulations can be run starting with a very small blockage (e.g., a triangle having a very small height) which can be cleared by the closed loop controller with a tension that is far from a maximum tension, signifying that there is substantially no risk of pumpoff. Subsequent simulations can be run with increasing size blockages (e.g., a triangle with larger heights). At some point, a final simulation will show the blockage being cleared with a tension that is very close to, at, or above the maximum tension. The size of the blockage for that final simulation can be deemed the maximum size blockage, or the limit blockage. If the maximum size blockage is too small, as described above, the operating regime can be flagged as too risky, as described herein.

In another embodiment, pumpoff risk can be determined based on the ability to increase support line feed rate given a certain operating regime. The outer diameter of a tool can be slightly smaller than the inner diameter of the wellbore, leaving a small annulus between the tool and the wellbore. Therefore, under normal operations, the pressure of pumpdown fluid applied from the surface is split between pressure buildup behind the tool and flow of pumpdown fluid in the annulus between the tool and the wall of the wellbore.

As described above, blockages can sometimes buildup in the well. Additionally, loose tolerances in tools or tubing can result in an uneven inner diameter of the wellbore. In some circumstances, the tool may reach a location in the wellbore where the tool's outer diameter approximately matches the inner diameter of the wellbore (e.g., due to blockages), which reduces the size of the annulus and/or blocks the annulus, meaning substantially all or all of the pressure of the pumpdown fluid is building up behind the tool to push the tool downwell because no pumpdown fluid is passing through the annulus. In such an operating regime, the speed of the tool can dramatically and rapidly increase, potentially causing pumpoff if the support line feed rate is not sufficiently high. The support line feed rate can be changed rapidly, but has a maximum rate.

Therefore, a model can be established based on a given pump rate to compute the highest possible speed the tool could travel if the annulus between the inner diameter of the wellbore and the outer diameter of the tool is substantially zero. The highest possible speed of the tool can be compared to the maximum support line feed rate. If the highest possible speed of the tool exceeds the maximum support line feed rate, a high-risk indication can be given. If the highest possible speed of the tool is within a certain percentage (e.g., 90%) of the maximum support line feed rate, a medium-risk indication can be given.

Similarly, given a particular support line feed rate, the model can be used to determine a highest pump rate. For example, the model can be used to determine the highest safe pump rate that would result in a highest possible speed at or under the current support line feed rate, thereby giving an operator a quantitative maximum pump rate under which pumpoff risk is acceptably low. As another example, the model can be used to determine the highest possible pump rate that would result in a highest possible speed at or under the maximum support line feed rate. It can be desirable to run the pump at this highest possible pump rate because it may lead to the quickest pumpdown operation.

Changes to the tolerance of this method, such as to make this method more or less sensitive, can be made by adjusting the percentages used, such as those used to compare the highest possible speed of the tool with the maximum support line feed rate.

In another embodiment, pumpoff risk can be assessed by comparing the deviation between modeled tension of the support line and actual, measured tension of the support line during a pumpdown procedure. A model, such as a mathematical (e.g., physics-based) model or an empirical (e.g., data-based) model, can take information about the current operating regime into consideration to determine a predicted support line tension. The model can predict one or both of a predicted surface wireline tension (e.g., as measured from the surface) and a predicted downhole wireline tension (e.g., as measured from the tool, downwell). The model can take into account variables such as inclination, current support line feed rate, current fluid flow rate, tool geometry, temperature, depth, and/or other factors.

The predicted support line tensions can be compared to actual, support line tension measurements taken by a tension meter positioned at the surface and/or a tension meter positioned at the tool. If the deviation, also known as residual error, surpasses a preset tolerance (e.g., a deviation of more than 10%), the pumpoff risk can be assessed as high and a high-risk indicator can be provided. If the deviation surpasses a lower preset tolerance (e.g., a deviation between 5% and 10%), the pumpoff risk can be assessed as medium and a medium-risk indicator can be provided. Other tolerance levels can be used. It can be assumed that the simulation model provides a very good approximate (e.g., below 5% error) to the actual (e.g., measured) tension in absence of blockages, but when blockages exist, the approximation becomes poor. Thus, a poor approximate can be indicative of blockages. The preset tolerance can be a percentage or a preset number (e.g., in pounds-force). Changes to the tolerance of this method, such as to make this method more or less sensitive, can be made by adjusting the percentage or number of the preset tolerance.

In another embodiment, pumpoff risk can be assessed by performing a statistical analysis of the results of a number of scenarios processed by a model. During a pumpdown procedure, a number of conditions change with respect to depth in the wellbore. Unknown or unexpected changes can be perturbations. Examples of perturbations include unknown conditions, such as blockages, as well as unexpected deviations in known conditions, such as unexpected inaccuracies of the measured inclination of a well during a well survey. Some example perturbations include changes in borehole radius, inclination, deficiencies in control, blockages, and other possible variables.

A number of different scenarios can be established with a statistical distribution of different perturbations, such as those described above, as well as certain constant inputs (e.g., information about well and/or tool geometry). Each of these scenarios can be evaluated by a model attempting to control the tension in the support line through a controller (e.g., the closed-loop controller) during a pumpdown procedure. The pump rate and support line feed rate can be monitored for each scenario to assess how much each must be adjusted to keep the support line tension within a predetermined range (e.g., within operating limits).

Some scenarios may evaluate with pump rates and/or support line feed rates outside of the predetermined range, thus indicating a high likelihood of pumpoff for that particular scenario. Each scenario can be assigned a weighting and a weighted average of the pumpoff risk of each scenario can be taken to determine the overall pumpoff risk for a particular pumpdown operation given certain constants.

If the overall risk is above a certain tolerance, a high-risk pumpoff indication may be given, indicating that the pumpdown operation should not be performed unless the constants are changed (e.g., by changing the tool geometry or by cleaning of the wellbore). If the overall risk is within a certain lower tolerance, a medium-risk pumpoff indication may be given, indicating that the pumpdown operation can continue, but must proceed with caution. In some embodiments, the medium-risk pumpoff indication may also correspond with an increase in the sensitivity of other dynamic pumpoff risk assessment methods used during the pumpdown procedure.

Through the aforementioned methods of assessing pumpoff risk, a quantitative measurement of risk can be obtained and used to provide indications to an operator (e.g., a human operator or a computerized pumpdown controller). The indications can be separated in any suitable way. In some embodiments, a high-risk indication is provided when the pumpdown operation should not proceed, as the likelihood of a pumpoff is very high. In some embodiments, a medium-risk indication is provided when the pumpdown operation can continue, but must continue with caution, as pumpoff risk is somewhat high. In some embodiments, a low-risk indication, or no indication, is provided when the pumpdown operation can continue as normal without any significant risk of pumpoff.

Some of the aforementioned methods can be performed prior to a pumpdown procedure to determine risk levels. Some of the aforementioned methods can be performed dynamically during a pumpdown procedure. When being performed dynamically, if the operating regime becomes one having a medium or high risk of pumpoff, an indication can be provided to either change the operating regime or signal an operator.

In an embodiment, a system that dynamically assesses pumpdown risk can provide a warning to a human operator when the current operating regime enters a medium risk of pumpoff. However, if the current operating regime enters a high risk of pumpoff, the system can automatically, without human intervention, cause a change to the operating regime to reduce the risk of pumpoff (e.g., by decreasing the pump flow rate, increasing line feed rate, or both).

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a schematic diagram of a wellbore servicing system 100 that includes a tool 108 positioned by a pumpdown operation, according to one embodiment. The wellbore servicing system 100 also includes a wellbore 102 penetrating a subterranean formation 104 for the purpose of recovering hydrocarbons, storing hydrocarbons, disposing of carbon dioxide, or the like. The wellbore 102 can be drilled into the subterranean formation 104 using any suitable drilling technique. While shown as extending vertically from the surface in FIG. 1, in other examples the wellbore 102 can be deviated, horizontal, or curved over at least some portions of the wellbore 102. The wellbore 102 can be cased, open hole, contain tubing, and can include a hole in the ground having a variety of shapes or geometries.

A service rig, such as a drilling rig, a completion rig, a workover rig, or other mast structure or combination thereof can support a support line 106 in the wellbore 102, but in other examples a different structure can support the support line 106. In some aspects, a service rig can include a derrick with a rig floor through which the support line 106 extends downward from the service rig into the wellbore 102. The servicing rig can be supported by piers extending downwards to a seabed in some implementations. Alternatively, the service rig can be supported by columns sitting on hulls or pontoons (or both) that are ballasted below the water surface, which may be referred to as a semi-submersible platform or rig. In an off-shore location, a casing may extend from the service rig to exclude sea water and contain drilling fluid returns. Other mechanical mechanisms that are not shown may control the run-in and withdrawal of the support line 106 in the wellbore 102. Examples of these other mechanical mechanisms include a draw works coupled to a hoisting apparatus, a slickline unit or a wireline unit including a winching apparatus, another servicing vehicle, or other such mechanisms. As used herein, the term support line feeder 136 refers to any mechanism used to feed the support line 106 into the wellbore 102 and/or determine the support line feed rate.

The support line 106 be a wireline or other suitable line for supporting a tool 108 positionable downwell by a pumpdown procedure. In some embodiments, the tool 108 is a perforating gun. The support line 106 can additionally supply the tool 108 with power, fluid, data communication, or other connection with the surface. The wellbore 102 can include a seal 112 into which a pressurized fluid can be injected behind the tool 108 (e.g., between the seal 112 and the tool 108) to force the tool 108 downwell. The seal 112 can be located at or adjacent the surface, or elsewhere. The pressurized fluid can be provided through a duct 116 by a pump 120. The pump flow rate of the pump 120 can be adjusted to increase or decrease the pressure build-up behind (e.g., above) the tool 108, thus forcing the tool 108 further downwell.

The support line 106 can support the tool 108 to pull the tool 108 out of the wellbore (e.g., upwards as seen in FIG. 1). The support line 106 can be coupled to a surface meter 122 capable of measuring the tension of the support line 106 at the surface. Additionally, a tool-mounted meter 118 can measure the tension of the support line 106 downwell.

The tool 108 can have a tool outer diameter 124. The tool outer diameter 124 can be slightly smaller than the wellbore inner diameter 128, allowing the tool to pass through the wellbore. An annulus 130 can exist between the tool outer diameter 124 and the wellbore inner diameter 128.

During a pumpdown procedure, the pump's 120 pump flow rate and the support line feed rate can be adjusted to position the tool 108 downwell at a desired location. Due to irregularities in the boring process and/or tubulars that make up the casing of the wellbore 102, the wellbore inner diameter 128 can be uneven. Additionally, blockages 110 can be present along the inner walls of the wellbore 102. Blockages 110 and other irregularities can result in restrictions 126 having diameters smaller than the tool outer diameter 124, thus stopping or slowing travel of the tool 108. Use of a higher pump flow rate can help dislodge blockages 110 and/or force the tool 108 past the blockage. In some cases, if the speed of the tool 108 surpasses the support line feed rate, pumpoff can occur (e.g., the support line 106 can become damaged and/or severed due to high tension).

A processor 132 can be coupled (e.g., wired or wirelessly) to the pump 120 and one or both of meter 122 and meter 118 for carrying out the methods described herein. The processor 132 can also be coupled to support line feeder 136. The processor 132 can be coupled to a memory 134 containing programming instructions for carrying out the methods described herein. The memory 134 can further contain the pumpdown models described herein. The memory 134 can by any non-transitory computer-readable storage medium.

Figure 2:
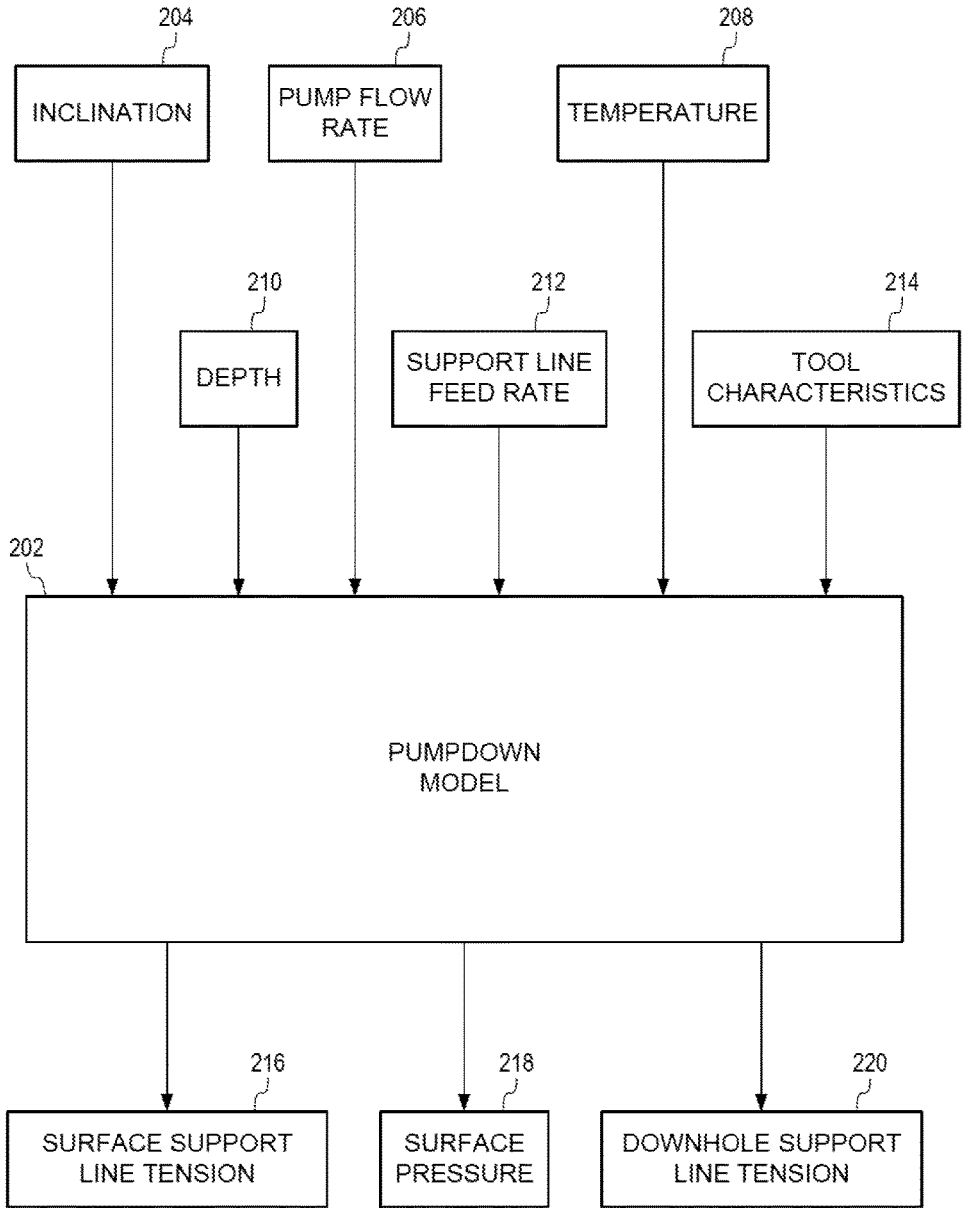
FIG. 2 is a schematic flow chart depicting use of a pumpdown model according to one embodiment.

FIG. 2 is a schematic flow chart depicting use of a pumpdown model 202 according to one embodiment. In some embodiments, the pumpdown model 202 is based on mathematical equations (e.g., physics equations). In alternate embodiments, the pumpdown model 202 is based on empirical data, such as statistical data obtained from previous pumpdown operations. In some embodiments, the pumpdown model 202 is based on a combination of mathematical equations and empirical data.

The pumpdown model 202 can accept a number of inputs and provide one or more outputs. Some example inputs include wellbore inclination 204 (e.g., at the tool location), tool depth 210, pump flow rate 206, support line feed rate 212, temperature 208 (e.g., temperature of the tool or around the tool), and tool characteristics 214 (e.g., shape of the tool, weight of the tool, outer diameter of the tool). Other suitable inputs can be used.

Applying the inputs to the pumpdown model 202 results in one or more outputs. Some example outputs include surface support line tension 216, (e.g., representing support line tension measured at the surface), surface pressure 218 (e.g., representing pressure of the fluid being used to propel the tool downwell or pressure measured at the surface), and downhole support line tension 220 (e.g., representing support line tension as measured at the tool). In some embodiments, the pumpdown model 202 can provide additional outputs.

The inputs to the pumpdown model 202 can be supplied from historical data, random data, pre-determined data (e.g., set by a user), or dynamically measured data.

The pumpdown model 202 can use a control mechanism, such as a closed loop controller, as described below.

Figure 3:
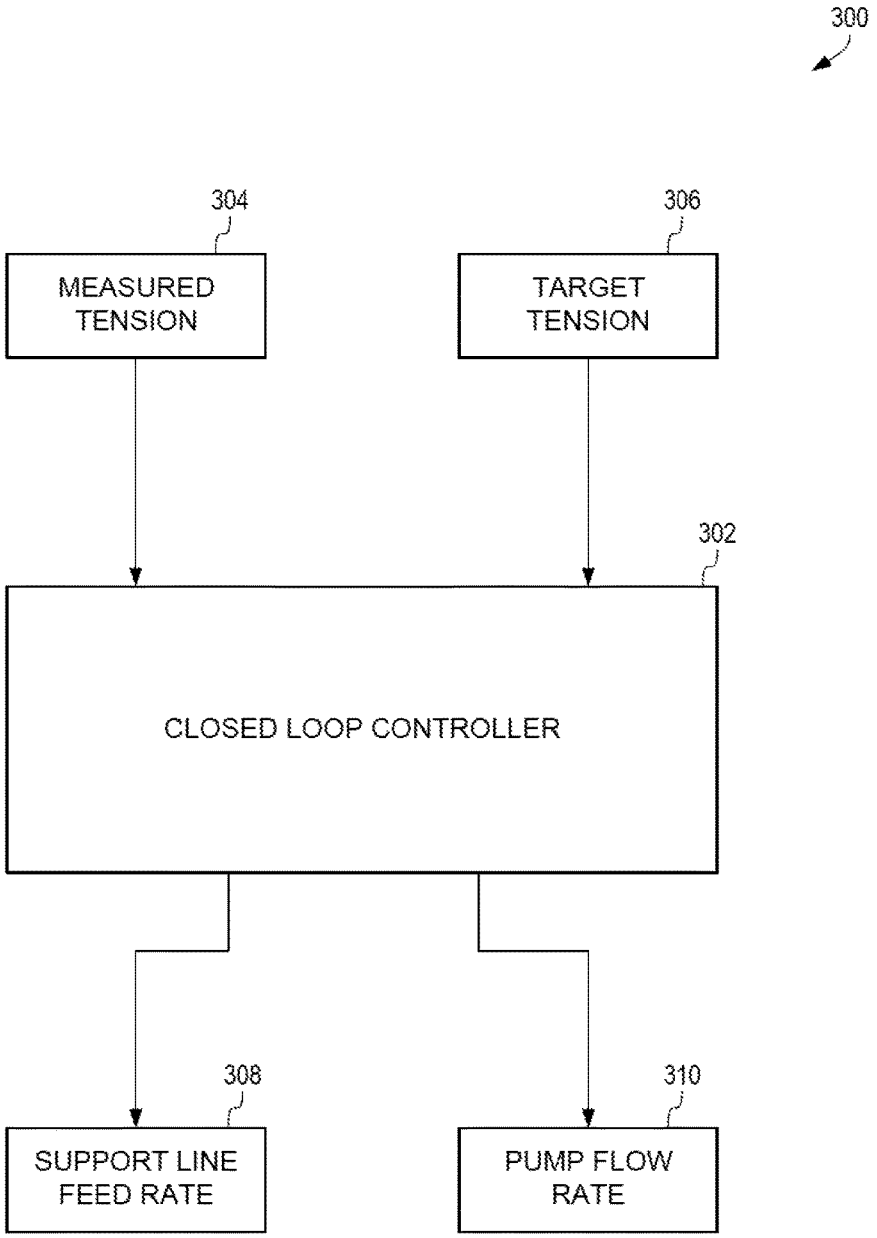
FIG. 3 is a schematic diagram depicting a control mechanism according to one embodiment.

FIG. 3 is a schematic diagram depicting a control mechanism 300 according to one embodiment. The control mechanism 300 can include a closed loop controller 302, although other controllers can be used. The closed loop controller 302 can receive as inputs a target tension 306 of the support line and a measured tension 304 of the support line. The measured tension 304 can be one or a combination (e.g., average or maximum) of a surface tension and a downwell tension. The closed loop controller 302 can then provide a desired support line feed rate 308 and a desired pump flow rate 310 as outputs. The closed loop controller 302 can be used with the pumpdown model 202 of FIG. 2 to generate accurate outputs of the pumpdown model 202.

Figure 4:
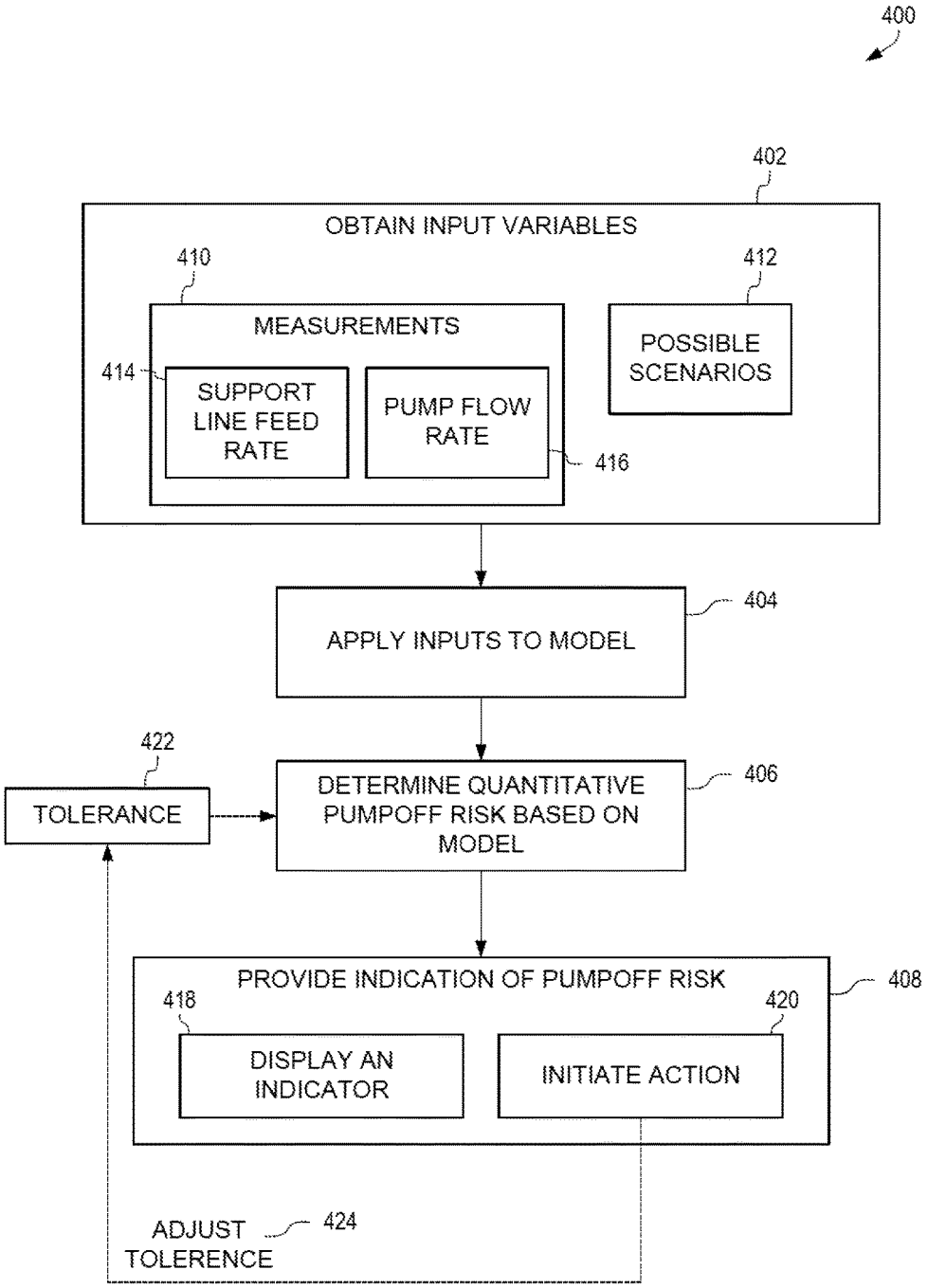
FIG. 4 is a schematic diagram depicting a method of assessing pumpoff risk according to one embodiment.

FIG. 4 is a schematic diagram depicting a method 400 of assessing pumpoff risk according to one embodiment. At block 402, input variables can be obtained. At block 404, the input variables can be applied to a model, such as the pumpdown model 202 from FIG. 2. At block 406, a quantitative pumpoff risk can be determined based on the model. At block 408, an indication of pumpoff risk can be provided.

Input variables that are obtained at block 402 can include measurements 410 and/or possible scenarios 412. Measurements 410 can include a support line feed rate 414 and/or a pump flow rate 416. Other variables can be measured and obtained at block 402, such as inclination, temperature, depth, and other suitable variables. Possible scenarios 412 can include one or more variables (e.g., a support line feed rate, a pump flow rate, or other variables) that are pre-determined or otherwise chosen (e.g., by user input). In some embodiments, input variables can include information about the well or pumpdown job, such as casing or tubing sizes, inclinations, and fluid characteristics. In some embodiments, information about the well or pumpdown job, such as casing or tubing sizes, inclinations, and fluid characteristics, can be incorporated into the model used.

At block 404, the input variables are applied to the model. In some embodiments, the input variables are applied to the model along with constants. For a particular pumpdown operation, an example of a constant can be the tool weight and tool geometry. Other constants can be used.

At block 406, a determination is made of the pumpoff risk. The pumpoff risk can be a quantitative pumpoff risk provided as a number. In some embodiments, the determination made at block 406 can be based on a tolerance 422. Pumpoff risk can be categorized as low, medium, or high. Other categorizations can be used.

At block 408, an indication of pumpoff risk is provided. The indication can be the presentation of an indicator at block 418 or the initiation of an action at block 420. Presenting an indicator at block 418 can include displaying lights and/or alerts, sounding alarms and/or buzzers, providing tactical feedback (e.g., vibration) or otherwise providing an sensory alert to a human operator. Initiating an action at block 420 can include adjusting the tolerance 422 of one or more methods 400 of assessing pumpoff at block 424. For example, if a medium or high pumpoff risk is determined at block 406, the action initiated at block 420 can be to adjust the tolerance 422 at block 424 so as to make the determination of pumpoff risk at block 406 on the same method 400 or other methods 400 more sensitive. In some embodiments, initiation of an action at block 420 can include initiating a change in the support line feed rate or pump flow rate (e.g., by sending control signals to a controller).

In some embodiments, providing an indication of pumpoff risk at block 408 can include displaying an indicator (e.g., lighting an alert lamp at a human operator's station) at block 418 in response to pumpoff risk falling within some categories (e.g., medium and high) and initiating an action (e.g., lowering pump flow rate) at block 420 in response to pumpoff risk falling within certain categories (e.g., high).

Figure 5:
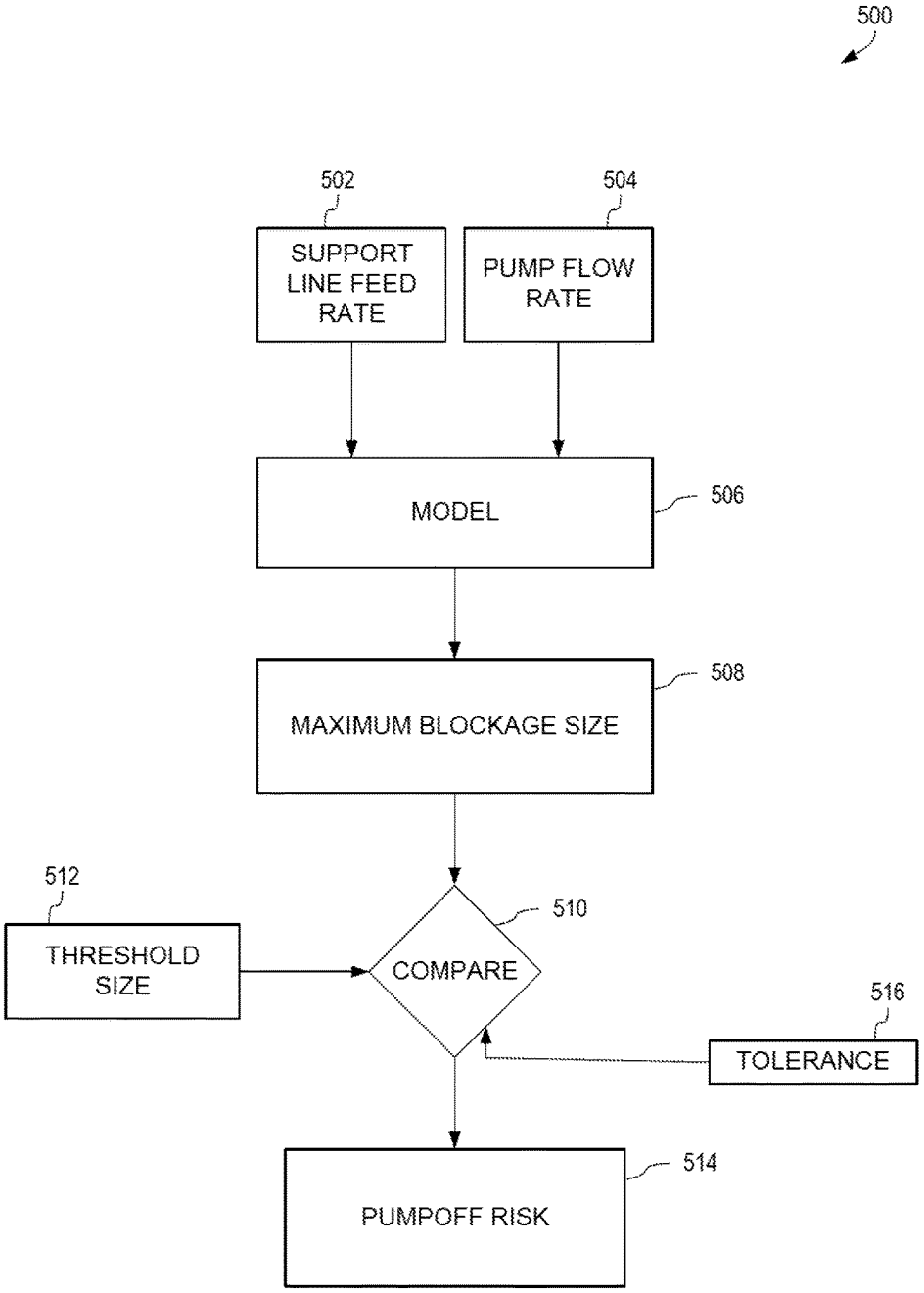
FIG. 5 is a schematic diagram depicting a method of assessing pumpoff risk according to one embodiment.

FIG. 5 is a schematic diagram depicting a method 500 of assessing pumpoff risk according to one embodiment. Support line feed rate 502 and pump flow rate 504 can be provided to a model 506. The support line feed rate 502 and pump flow rate 504 can be provided based on user input (e.g., in order to determine parameters for a future pumpdown operation) or based on live measurements (e.g., in order to provide indications of pumpoff risk dynamically, during a pumpdown operation).

The model 506 can output a maximum blockage size 508 that can be cleared, given the support line feed rate 502 and pump flow rate 504. The maximum blockage size 508 can be compared at block 510 to a threshold size 512. The threshold size 512 can be based on user input and/or a pre-determined safe threshold size. The comparison between the maximum blockage size 508 and the threshold size 512 at block 510 can result in a pumpoff risk 514. If the maximum blockage size 508 is within a certain tolerance 516 of the threshold size 512, it can be determined to be a certain category of pumpoff risk (e.g., high-risk). The tolerance 516 can also include a second tolerance range, wherein if the maximum blockage size 508 is within the second tolerance range of the threshold size 512, it can be determined to be a different category of pumpoff risk (e.g., medium-risk). The tolerance 516 can include additional ranges as well. Based on the comparison at block 510, the method 500 can provide an evaluation of pumpoff risk 514.

As described herein, the tolerance 516 can be adjusted to make the determination of pumpoff risk 514 more or less sensitive.

Figure 6:
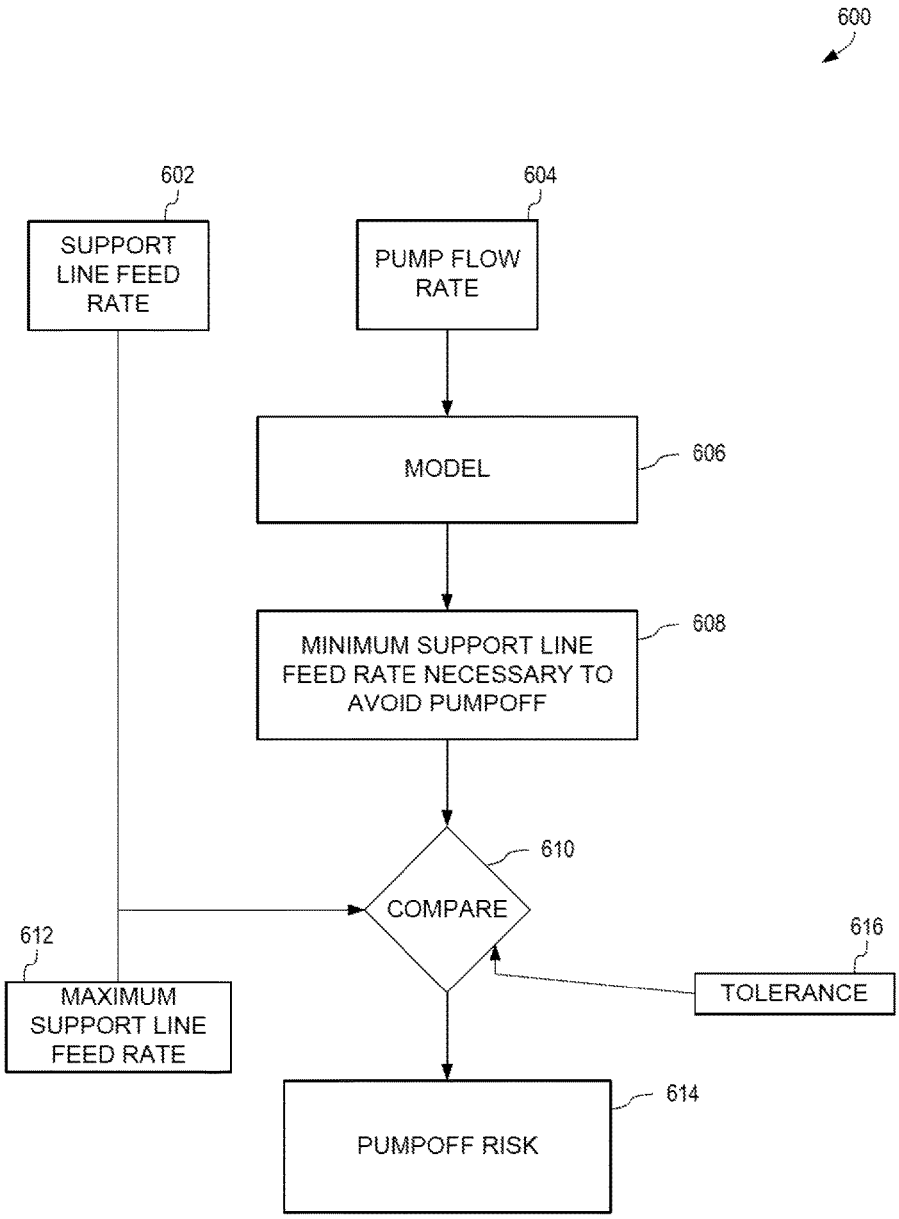
FIG. 6 is a schematic diagram depicting a method of assessing pumpoff risk according to one embodiment.

FIG. 6 is a schematic diagram depicting a method 600 of assessing pumpoff risk according to one embodiment. A pump flow rate 604 can be provided to a model 606. The pump flow rate 604 can be provided based on user input (e.g., in order to determine parameters for a future pumpdown operation) or based on live measurements (e.g., in order to provide indications of pumpoff risk dynamically, during a pumpdown operation).

The model 606 can output a minimum support line feed rate necessary to avoid pumpoff 608, given the pump flow rate 604. The minimum support line feed rate necessary to avoid pumpoff 608 can be compared at block 610 to one of the support line feed rate 602 and a maximum support line feed rate 612. The support line feed rate 602 can be based on user input or based on live measurements. The maximum support line feed rate 612 can be based on the equipment's safe operating ranges.

The comparison between the minimum support line feed rate necessary to avoid pumpoff 608 and the support line feed rate 602 or maximum support line feed rate 612 at block 610 can result in a pumpoff risk 614. If the minimum support line feed rate necessary to avoid pumpoff 608 is within a certain tolerance 616 of the support line feed rate 602 or maximum support line feed rate 612, it can be determined to be a certain category of pumpoff risk (e.g., high-risk). The tolerance 616 can also include a second tolerance range, wherein if the minimum support line feed rate necessary to avoid pumpoff 608 is within the second tolerance range of the support line feed rate 602 or maximum support line feed rate 612, it can be determined to be a different category of pumpoff risk (e.g., medium-risk). The tolerance 616 can include additional ranges as well. Based on the comparison at block 610, the method 600 can provide an evaluation of pumpoff risk 614.

As described herein, the tolerance 616 can be adjusted to make the determination of pumpoff risk 614 more or less sensitive.

In some embodiments, comparing the minimum support line feed rate necessary to avoid pumpoff 608 that is based on a measured pump flow rate 604 to a measured support line feed rate 602 can be indicative of the pumpoff risk currently present in the system. For example, if the minimum support line feed rate necessary to avoid pumpoff 608 exceeds the support line feed rate 602, the pumpoff risk 614 can indicate a medium-risk, giving an operator an opportunity to increase the support line feed rate 602. Additionally, if the minimum support line feed rate necessary to avoid pumpoff 608 exceeds the maximum support line feed rate 612, the pumpoff risk 614 can indicate a high-risk, giving an operator an opportunity to decrease the pump flow rate 604, because no adjustment in support line feed rate 602 would be sufficient to avoid pumpoff under certain conditions (e.g., the tool encountering a restriction 126 sized exactly the outer diameter of the tool).

Figure 7:
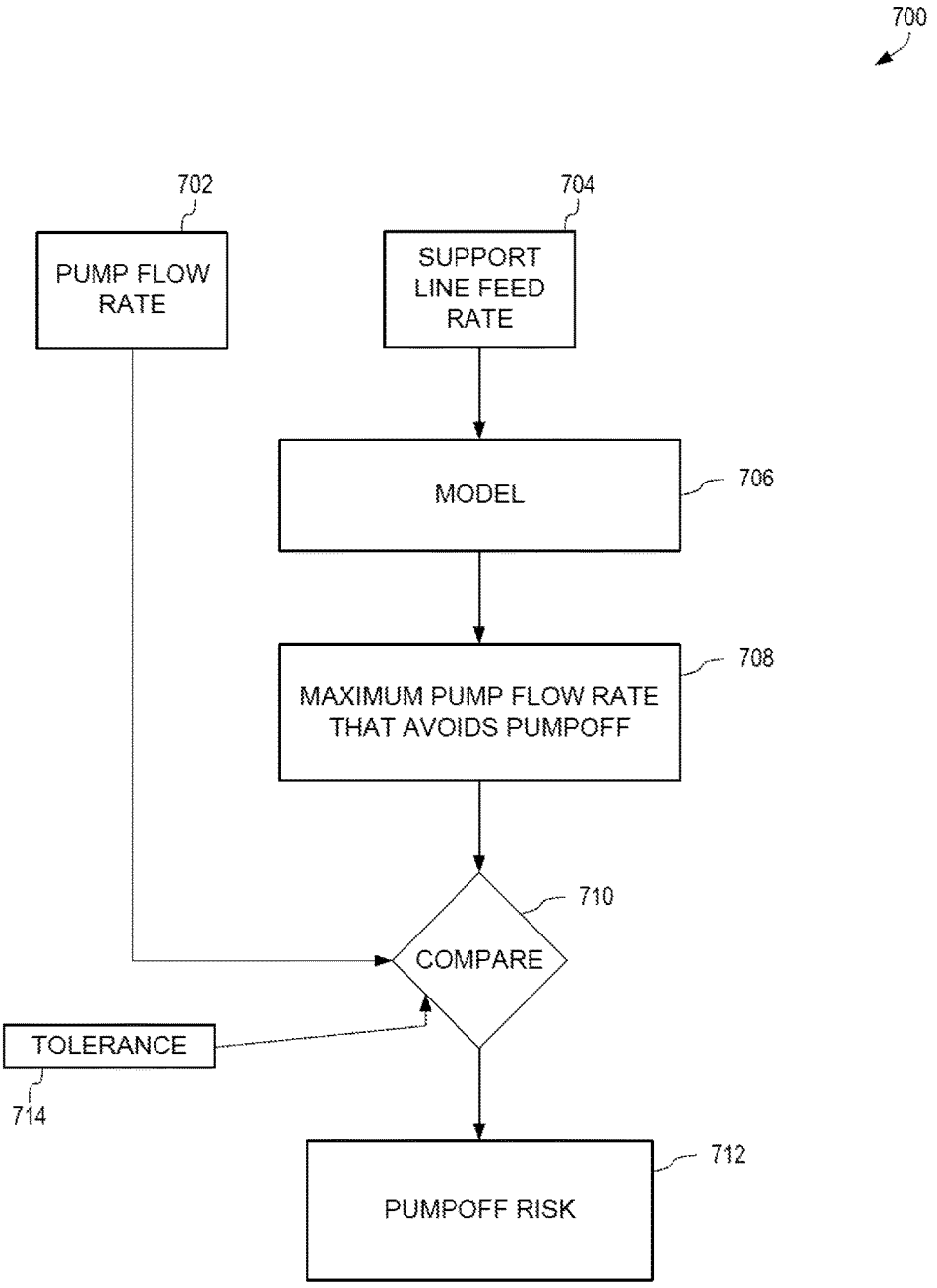
FIG. 7 is a schematic diagram depicting a method of assessing pumpoff risk according to one embodiment.

FIG. 7 is a schematic diagram depicting a method 700 of assessing pumpoff risk according to one embodiment. A support line feed rate 704 can be provided to a model 706. The support line feed rate 704 can be provided based on user input (e.g., in order to determine parameters for a future pumpdown operation) or based on live measurements (e.g., in order to provide indications of pumpoff risk dynamically, during a pumpdown operation).

The model 706 can output a maximum pump flow rate that avoids pumpoff 708, given the support line feed rate 704. The maximum pump flow rate that avoids pumpoff 708 can be compared at block 710 to the pump flow rate 702. The pump flow rate 702 can be based on user input or based on live measurements.

The comparison between the maximum pump flow rate that avoids pumpoff 708 and the pump flow rate 702 at block 710 can result in a pumpoff risk 712. If the maximum pump flow rate that avoids pumpoff 708 is within a certain tolerance 714 of the pump flow rate 702, it can be determined to be a certain category of pumpoff risk (e.g., high-risk). The tolerance 714 can also include a second tolerance range, wherein if the maximum pump flow rate that avoids pumpoff 708 is within the second tolerance range of the pump flow rate 702, it can be determined to be a different category of pumpoff risk (e.g., medium-risk). The tolerance 716 can include additional ranges as well. Based on the comparison at block 710, the method 700 can provide an evaluation of pumpoff risk 712.

As described herein, the tolerance 714 can be adjusted to make the determination of pumpoff risk 712 more or less sensitive.

This method 700 can be used to determine a maximum pump flow rate to use given a particular maximum support line feed rate, allowing an operator to choose the highest possible pump flow rate for a particular pumpdown operation.

Figure 8:
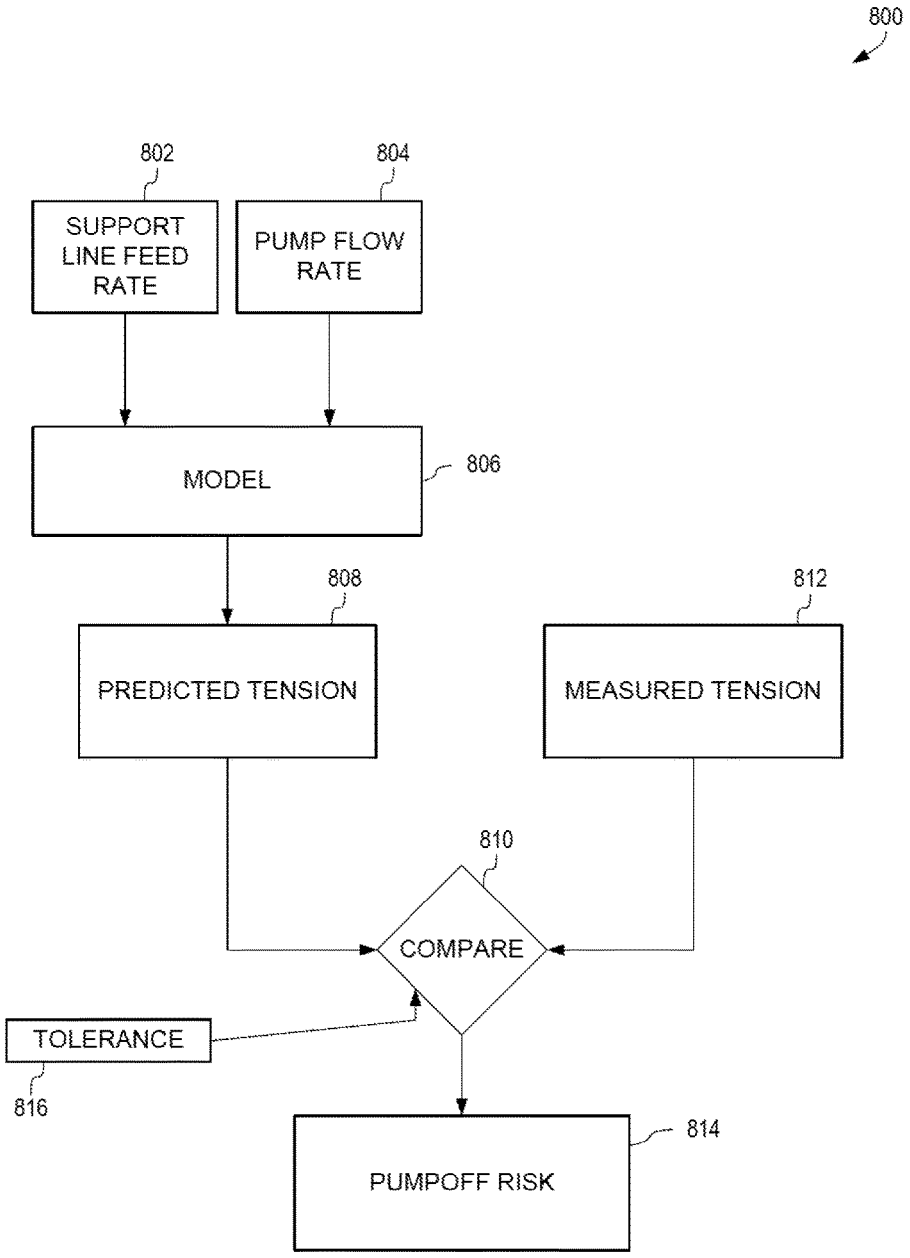
FIG. 8 is a schematic diagram depicting a method of assessing pumpoff risk according to one embodiment.

FIG. 8 is a schematic diagram depicting a method 800 of assessing pumpoff risk according to one embodiment. Support line feed rate 802 and pump flow rate 804 can be provided to a model 806. The support line feed rate 802 and pump flow rate 804 can be provided based on user input (e.g., in order to determine parameters for a future pumpdown operation) or based on live measurements (e.g., in order to provide indications of pumpoff risk dynamically, during a pumpdown operation).

The model 806 can output a predicted tension 808 of the support line at a particular location in the well, given the support line feed rate 802 and pump flow rate 804. The predicted tension 808 can be compared at block 810 to a measured tension 812 of the support line (e.g., one of or a combination of a surface tension and a downwell tension). The comparison (e.g., deviation) between the predicted tension 808 and the measured tension 812 at block 810 can result in a pumpoff risk 814. If the predicted tension 808 is within a certain tolerance 816 (e.g., within a deviation threshold) of the measured tension 812, it can be determined to be a certain category of pumpoff risk (e.g., high-risk). The tolerance 816 can also include a second tolerance range, wherein if the predicted tension 808 is within the second tolerance range of the measured tension 812, it can be determined to be a different category of pumpoff risk (e.g., medium-risk). The tolerance 816 can include additional ranges as well. Based on the comparison at block 810, the method 800 can provide an evaluation of pumpoff risk 814.

At block 810, predicted tension 808 and measured tension 812 can be compared over a single instant (e.g., a single measurement and a single prediction) to determine a deviation that can be used to determine pumpoff risk 814. In some embodiments, at block 810, predicted tension 808 and measured tension 812 can be compared over time to determine a rate of change of the deviations between predicted tension 808 and measured tension 812. This rate of change can be compared to a tolerance 816 (e.g., a rate-of-change threshold) to determine the pumpoff risk 814. For example, if the rate of change of deviations increases beyond a rate-of-change threshold, a high-risk indication can be provided.

As described herein, the tolerance 816 can be adjusted to make the determination of pumpoff risk 814 more or less sensitive.

Figure 9:
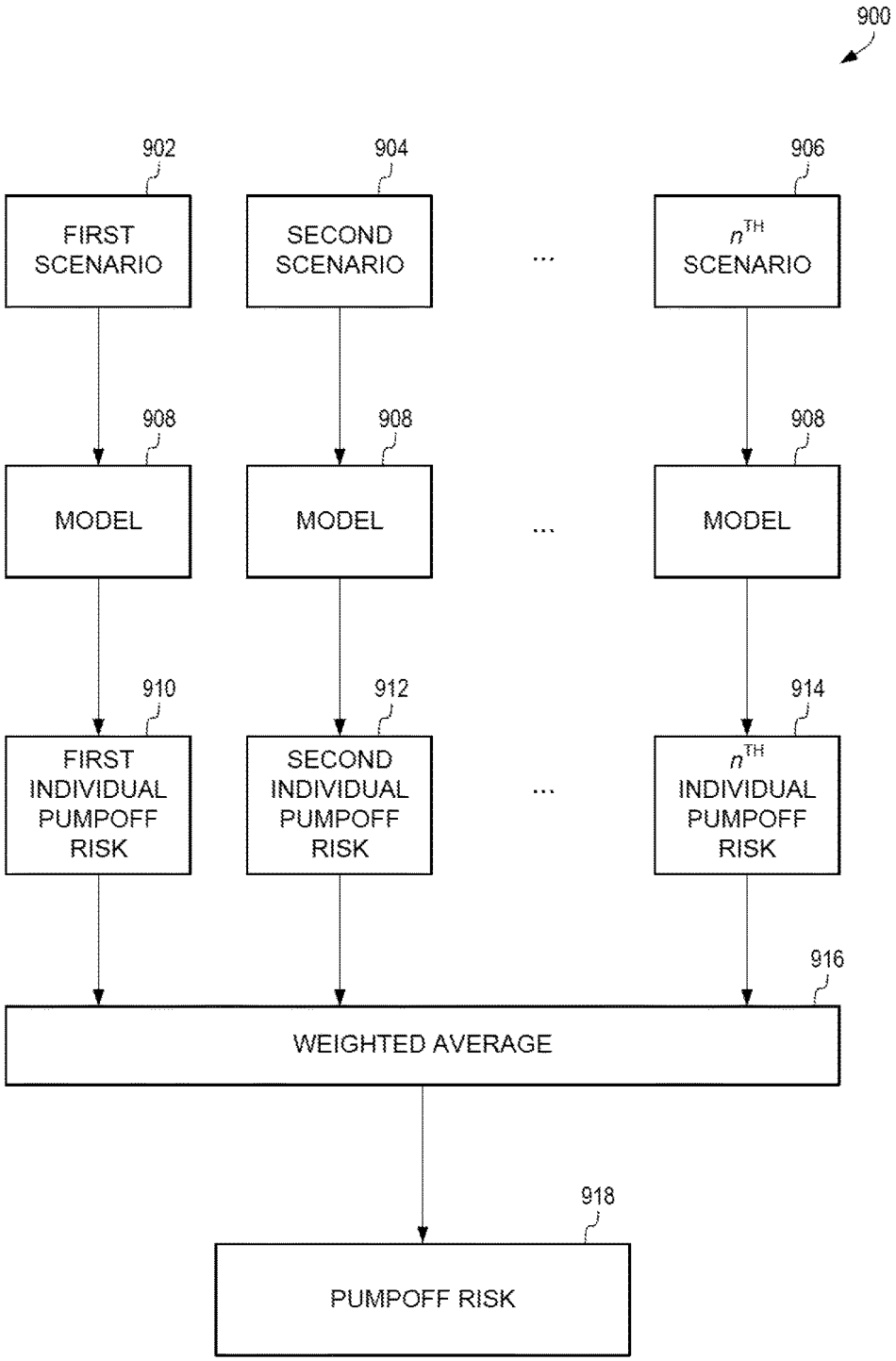
FIG. 9 is a schematic diagram depicting a method of assessing pumpoff risk according to one embodiment.

FIG. 9 is a schematic diagram depicting a method 900 of assessing pumpoff risk according to one embodiment. Multiple scenarios 902, 904, 906 are input into a model 908 in order to determine individual pumpoff risks 910, 912, 914 for each respective scenario 902, 904, 906. Each scenario 902, 904, 906 can include variables and perturbations, each potentially resulting in a different pumpoff risk. A weighted average is taken of the individual pumpoff risks 910, 912, 914 at block 916, which is used to determine the pumpoff risk 918. Pumpoff risk 918 can be a quantitative pumpoff risk 918.

For example, a first scenario 902 may include a significant number of blockages of large size. As the model 908 is evaluated for the first scenario 902, the closed loop controller of the model 908 requires the pump flow rate or support line feed rate to exceed safe operating conditions in order to maintain target tension, thereby indicating a first individual pumpoff risk 910 that is high-risk. It can be determined that the presence of a significant number of blockages of large size is not highly likely, so the first individual pumpoff risk 910 can be given a low weighting when the weighted average is determined at block 916.

In another example, a second scenario 904 may include several small deviations in inclination and small blockages. As the model 908 is evaluated for the second scenario 904, the closed loop controller of the model 908 is able to maintain target tension easily, thereby indicating a second individual pumpoff risk 912 that is low. It can be determined that the presence of small deviations in inclination and small blockages is very likely, so the second individual pumpoff risk 912 can be given a high weighting when the weighted average is determined at block 916.

This method 900 can be used to determine a quantitative pumpoff risk 918 prior to performing a pumpdown operation. If the pumpoff risk 918 is higher than acceptable, operations can be conducted to improve the outlook of the pumpdown operation, such as by cleaning the wellbore prior to pumpdown. The results of the operations (e.g., cleaning the wellbore) can be incorporated into the scenarios 902, 904, 906 and/or model 908 in order to determine if the operations would result in an acceptable level of pumpoff risk 918.

Figure 10:
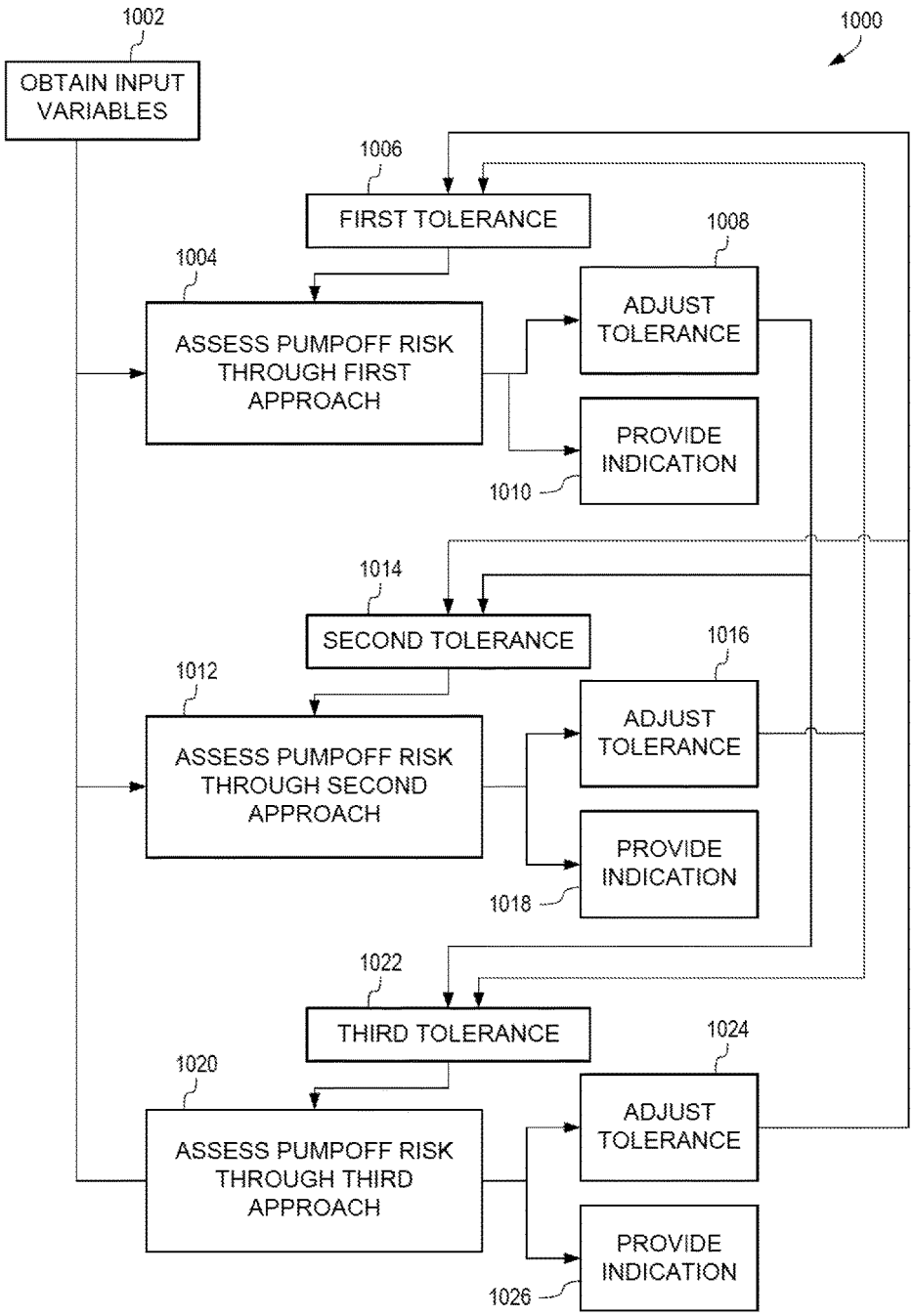
FIG. 10 is a schematic flow chart depicting a method of assessing pumpoff risk according to one embodiment.

FIG. 10 is a schematic flow chart depicting a method 1000 of assessing pumpoff risk according to one embodiment. At block 1002, input variables can be obtained, such as through measurement during a pumpdown operation. Input variables can be pump flow rate and support line feed rate. Input variables can be provided other than by measurement (e.g., provided by a user).

At blocks 1004, 1012, and 1020, pumpoff risk can be assessed through a various approaches (e.g., one of methods 500, 600, 700, 800, 900). Each approach can be based on a tolerance 1006, 1014, 1022.

Based on the assessed pumpoff risk from block 1004, an indication can be provided at block 1010 and/or a tolerance can be adjusted at block 1008. Block 1008 can adjust the second tolerance 1014 and/or the third tolerance 1022.

Based on the assessed pumpoff risk from block 1012, an indication can be provided at block 1018 and/or a tolerance can be adjusted at block 1016. Block 1016 can adjust the first tolerance 1006 and/or the third tolerance 1022.

Based on the assessed pumpoff risk from block 1020, an indication can be provided at block 1026 and/or a tolerance can be adjusted at block 1024. Block 1024 can adjust the first tolerance 1006 and/or the second tolerance 1014.

In some embodiments, blocks 1008, 1016, 1024 can adjust their own tolerances 1006, 1014, 1022, respectively.

In some embodiments, this method 1000 can be used to provide a positive feedback circuit for detecting pumpoff risk. As the risk for pumpoff increases, the sensitivity to pumpoff risk increases so that operating regimes that would otherwise not be categorized as high-risk may now be categorized as high-risk. This positive feedback circuit can help provide earlier responses and ultimate reduce the chance of pumpoff.

As used herein, the categories of medium-risk and high-risk can correspond with "proceed with caution" and "do not proceed" categories, respectively.

The operations described above can be applied to a tool running in any tubular, not just a tool running in a wellbore.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a method including obtaining one or more input variables representative of a pumpdown operation; applying the one or more input variables to a pumpdown model; determining a pumpoff risk based on applying the one or more input variables to the pumpdown model; and providing an indication based on the pumpoff risk.

Example 2 is the method of example 1 where obtaining the one or more input variables comprises establishing a plurality of scenarios based on one or more perturbations; applying the one or more input variables to the pumpdown model comprises evaluating the pumpdown model for each of the plurality of scenarios to determine an individual pumpoff risk for each of the plurality of scenarios; and determining the pumpoff risk comprises providing a weighting to each of the plurality of scenarios and calculating a weighted average of the individual pumpoff risk for each of the plurality of scenarios.

Example 3 is the method of example 1 where obtaining the one or more input variables comprises measuring at least one of a support line feed rate of a support line and a pump flow rate; and determining the pumpoff risk is based on applying at least one of the support line feed rate and the pump flow rate to the pumpdown model.

Example 4 is the method of examples 1-3 where providing the indication comprises presenting a medium-risk indicator to a human operator when the pumpoff risk is within a threshold; and initiating an action to reduce the pumpoff risk when the pumpoff risk is above the threshold.

Example 5 is the method of examples 1-4 where providing the indication comprises initiating an action to adjust at least one of the support line feed rate and the pump flow rate to reduce the pumpoff risk.

Example 6 is the method of examples 1-5 where applying the one or more input variables comprises determining a maximum blockage size that can be cleared based on applying the support line feed rate and the pump flow rate to the pumpdown model; and determining the pumpoff risk comprises comparing the maximum blockage size to a threshold size.

Example 7 is the method of examples 1-6, where applying the one or more input variables comprises applying the pump flow rate to the pumpdown model to determine a minimum support line feed rate necessary to avoid pumpoff; and determining the pumpoff risk comprises comparing the minimum support line feed rate necessary to avoid pumpoff to at least one of the support line feed rate and a maximum support line feed rate.

Example 8 is the method of examples 1-7 where applying the one or more input variables comprises applying the support line feed rate to the pumpdown model to determine a maximum pump flow rate that avoids pumpoff; and determining the pumpoff risk comprises comparing the maximum pump flow rate that avoids pumpoff to the pump flow rate.

Example 9 is the method of examples 1-8 also including measuring a tension of the support line, where applying the one or more input variables comprises determining a predicted tension of the support line based on applying the support line feed rate and the pump flow rate to the pumpdown model; and determining the pumpoff risk comprises calculating a deviation between the predicted tension and the measured tension and comparing the deviation to a deviation threshold to determine the pumpoff risk.

Example 10 is the method of examples 1-9 also including measuring a tension of the support line, where applying the one or more input variables comprises determining a predicted tension of the support line based on applying the support line feed rate and the pump flow rate to the pumpdown model; and determining the pumpoff risk comprises calculating a deviation between the predicted tension and the measured tension, calculating a rate of change of the deviation, and comparing the rate of change of the deviation to a rate-of-change threshold to determine the pumpoff risk.

Example 11 is the method of examples 1-10 where determining the pumpoff risk is based on a tolerance. The method further includes determining a second pumpoff risk and adjusting the tolerance based on the second pumpoff risk.

Example 12 is a system including a pump operable to provide a pressurized fluid into a wellbore at a pump flow rate; a support line feeder operable to feed a support line supporting a tool into the wellbore at a support line feed rate; a meter operable to detect a tension in the support line; a processor coupled to the pump, the support line feeder, and the meter; and a non-transitory computer-readable storage medium. The storage medium contains instructions which, when executed on the processor, cause the processor to perform operations including: applying at least one of the pump flow rate and the tension to a pumpdown model; determining a pumpoff risk based on applying the at least one of the pump flow rate and the tension to the pumpdown model; and providing an indication based on the pumpoff risk.

Example 13 is the system of example 12 where the instructions that cause the processor to provide the indication based on the pumpoff risk further cause the processor to perform operations including: presenting a medium-risk indicator to a human operator when the pumpoff risk is within a threshold; and adjusting at least one of the pump and the support line feeder to reduce the pumpoff risk when the pumpoff risk is above the threshold.

Example 14 is the system of examples 12 or 13 where the instructions cause the processor to perform operations including: determining a maximum blockage size that can be cleared based on applying the support line feed rate and the pump flow rate to the pumpdown model; and comparing the maximum blockage size to a threshold size to determine the pumpoff risk.

Example 15 is the system of examples 12-14 where the instructions cause the processor to perform operations including: determining a predicted tension of the support line based on applying the support line feed rate and the pump flow rate to the pumpdown model; calculating a deviation between the predicted tension and the tension in the support line; and comparing the deviation to a deviation threshold to determine the pumpoff risk.

Example 16 is the system of examples 12-15 where determining the pumpoff risk is based on a tolerance, and wherein the instructions cause the processor to perform operations including: determining a second pumpoff risk and adjusting the tolerance based on the second pumpoff risk.

Example 17 is a method including measuring a support line feed rate of a support line coupled to a tool in a wellbore; measuring a pump flow rate of a pump providing pressurized fluid to the wellbore; applying at least one of the support line feed rate and the pump flow rate to a pumpdown model; dynamically determining a pumpoff risk based on applying the at least one of the support line feed rate and the pump flow rate to the pumpdown model; and providing an indication based on the pumpoff risk.

Example 18 is the method of example 17 where providing the indication includes presenting at least one of a high-risk indication or a medium-risk indication to a human operator.

Example 19 is the method of examples 17 or 18 where providing the indication comprises initiating an action to adjust at least one of the support line feed rate and the pump flow rate to reduce the pumpoff risk.

Example 20 is the method of examples 17-19 where dynamically determining the pumpoff risk is based on a tolerance. The method further includes dynamically determining a second pumpoff risk and adjusting the tolerance based on the second pumpoff risk.

What is claimed is:

1. A system, comprising:

a pump operable to provide a pressurized fluid into a wellbore at a pump flow rate;

a support line feeder operable to feed a support line supporting a tool into the wellbore at a support line feed rate;

a meter operable to detect a tension in the support line;

a processor coupled to the pump, the support line feeder, and the meter; and a non-transitory computer-readable storage medium containing instructions which, when executed on the processor, cause the processor to perform operations including:

applying at least one of the pump flow rate and the tension to a pumpdown model;

determining a pumpoff risk based on applying the at least one of the pump flow rate and the tension to the pumpdown model; and providing an indication based on the pumpoff risk.

2. The system of claim 1, wherein the instructions that cause the processor to provide the indication based on the pumpoff risk further cause the processor to perform operations including:

displaying a medium-risk indicator when the pumpoff risk is within a threshold; and adjusting at least one of the pump and the support line feeder to reduce the pumpoff risk when the pumpoff risk is above the threshold.

3. The system of claim 1, wherein the instructions cause the processor to perform operations including:

determining a maximum blockage size that can be cleared based on applying the support line feed rate and the pump flow rate to the pumpdown model; and comparing the maximum blockage size to a threshold size to determine the pumpoff risk.

4. The system of claim 1, wherein the instructions cause the processor to perform operations including:

determining a predicted tension of the support line based on applying the support line feed rate and the pump flow rate to the pumpdown model;

calculating a deviation between the predicted tension and the tension in the support line; and comparing the deviation to a deviation threshold to determine the pumpoff risk.

5. The system of claim 1, wherein determining the pumpoff risk is based on a tolerance, and wherein the instructions cause the processor to perform operations including:

determining a second pumpoff risk; and adjusting the tolerance based on the second pumpoff risk.

6. A method, comprising:

obtaining one or more input variables representative of a pumpdown operation;

applying the one or more input variables to a pumpdown model;

determining a pumpoff risk based on applying the one or more input variables to the pumpdown model; and providing an indication based on the pumpoff risk.

7. The method of claim 6, wherein:

obtaining the one or more input variables comprises establishing a plurality of scenarios based on one or more perturbations;

applying the one or more input variables to the pumpdown model comprises evaluating the pumpdown model for each of the plurality of scenarios to determine an individual pumpoff risk for each of the plurality of scenarios; and determining the pumpoff risk comprises providing a weighting to each of the plurality of scenarios and calculating a weighted average of the individual pumpoff risk for each of the plurality of scenarios.

8. The method of claim 7, wherein:

obtaining the one or more input variables comprises measuring at least one of a support line feed rate of a support line and a pump flow rate; and determining the pumpoff risk is based on applying at least one of the support line feed rate and the pump flow rate to the pumpdown model.

9. The method of claim 8, wherein providing the indication comprises:

displaying a medium-risk indicator when the pumpoff risk is within a threshold; and initiating an action to reduce the pumpoff risk when the pumpoff risk is above the threshold.

10. The method of claim 8, wherein:

applying the one or more input variables comprises determining a maximum blockage size that can be cleared based on applying the support line feed rate and the pump flow rate to the pumpdown model; and determining the pumpoff risk comprises comparing the maximum blockage size to a threshold size.

11. The method of claim 8, wherein:

applying the one or more input variables comprises applying the pump flow rate to the pumpdown model to determine a minimum support line feed rate necessary to avoid pumpoff; and determining the pumpoff risk comprises comparing the minimum support line feed rate necessary to avoid pumpoff to at least one of the support line feed rate and a maximum support line feed rate.

12. The method of claim 8, wherein:

applying the one or more input variables comprises applying the support line feed rate to the pumpdown model to determine a maximum pump flow rate that avoids pumpoff; and determining the pumpoff risk comprises comparing the maximum pump flow rate that avoids pumpoff to the pump flow rate.

13. The method of claim 8, further comprising measuring a tension of the support line, wherein:

applying the one or more input variables comprises determining a predicted tension of the support line based on applying the support line feed rate and the pump flow rate to the pumpdown model; and determining the pumpoff risk comprises:

calculating a deviation between the predicted tension and the measured tension; and comparing the deviation to a deviation threshold to determine the pumpoff risk.

14. The method of claim 8, further comprising measuring a tension of the support line, wherein:

applying the one or more input variables comprises determining a predicted tension of the support line based on applying the support line feed rate and the pump flow rate to the pumpdown model; and determining the pumpoff risk comprises:

calculating a deviation between the predicted tension and the measured tension;

calculating a rate of change of the deviation; and comparing the rate of change of the deviation to a rate-of-change threshold to determine the pumpoff risk.

15. The method of claim 6, wherein determining the pumpoff risk is based on a tolerance, the method further comprising:

determining a second pumpoff risk; and adjusting the tolerance based on the second pumpoff risk.

16. The method of claim 6, further comprising pumping a fluid into a wellbore at a pump flow rate and measuring a tension of a support line, wherein at least one of the one or more input variables relates to the tension in the support line or the pump flow rate.

17. A method, comprising:

measuring a support line feed rate of a support line coupled to a tool in a wellbore;

measuring a pump flow rate of a pump providing pressurized fluid to the wellbore;

applying at least one of the support line feed rate and the pump flow rate to a pumpdown model;

dynamically determining a pumpoff risk based on applying the at least one of the support line feed rate and the pump flow rate to the pumpdown model; and providing an indication based on the pumpoff risk.

18. The method of claim 17, wherein providing the indication includes displaying at least one of a high-risk indication or a medium-risk indication.

19. The method of claim 17, wherein providing the indication comprises initiating an action to adjust at least one of the support line feed rate and the pump flow rate to reduce the pumpoff risk.

20. The method of claim 17, wherein dynamically determining the pumpoff risk is based on a tolerance, the method further comprising:

dynamically determining a second pumpoff risk; and adjusting the tolerance based on the second pumpoff risk.

* * * * *